US006632989B2

(12) United States Patent
Yoshino et al.

(10) Patent No.: US 6,632,989 B2
(45) Date of Patent: Oct. 14, 2003

(54) ELECTRONIC PAD WITH VIBRATION ISOLATION FEATURES

(75) Inventors: Kiyoshi Yoshino, Hamamatsu (JP); Masato Katsuda, Hamamatsu (JP)

(73) Assignee: Roland Corporation, Los Angeles, CA (US)

( * ) Notice: Subject to any disclaimer, the term of this patent is extended or adjusted under 35 U.S.C. 154(b) by 0 days.

(21) Appl. No.: 09/935,275

(22) Filed: Aug. 22, 2001

(65) Prior Publication Data

US 2002/0059861 A1 May 23, 2002

(30) Foreign Application Priority Data

Aug. 22, 2000 (JP) ..... 2000-250765
Jan. 5, 2001 (JP) ..... 2001-000318

(51) Int. Cl.[7] ..... G10D 13/08
(52) U.S. Cl. ..... 84/402; 84/723
(58) Field of Search ..... 84/402–410, 411 R, 84/411 A, 411 M, 411 P, 412–421, 422.1, 422.2, 422.3, 422.4, 723–746, DIG. 12, DIG. 24

(56) References Cited

U.S. PATENT DOCUMENTS 4,102,235 A * 7/1978 Le Masters ..... 84/411 R
4,479,412 A * 10/1984 Klynas ..... 84/DIG. 12
4,581,973 A * 4/1986 Hoshino ..... 84/DIG. 12
5,105,710 A * 4/1992 Rothmel ..... 84/DIG. 12
5,262,585 A * 11/1993 Greene et al. ..... 84/DIG. 12
5,293,000 A * 3/1994 Adinolfi ..... 84/DIG. 12
5,492,047 A * 2/1996 Oliveri ..... 84/411 M
5,493,942 A * 2/1996 Wolf ..... 84/411 R
5,915,289 A * 6/1999 Hart ..... 84/402 X
5,922,980 A * 7/1999 Arteaga ..... 84/411 M
6,031,176 A * 2/2000 Tanaka ..... 84/735
6,331,667 B1 * 12/2001 Küppers ..... 84/422.3

* cited by examiner

*Primary Examiner*—Jeffrey Donels
(74) *Attorney, Agent, or Firm*—Foley & Lardner

(57) ABSTRACT

The present invention is intended to provide an electronic cymbal having improved accuracy for detecting a striking force and a striking position without hampering a striking sensation and an appearance. A piezoelectric sensor 5 and a cup portion sheet sensor 8 provided on a portion of a cup portion formed into a dome shape at a center of a cover 2 on a first frame 3 having the cover 2 formed out of a soft material, the cover 2 spreading to contact with an upper surface of the first frame 3, and an edge upper portion sheet sensor 7 and an edge lower portion sheet sensor 6 provided on an outer peripheral edge portion 3*b* formed to be lowered by a step are provided, and a center of a second frame 4 is supported by a cymbal stand (shaft) 10 penetrating an opening portion at a center of the first frame 3.

29 Claims, 11 Drawing Sheets

ELECTRONIC PAD WITH VIBRATION ISOLATION FEATURES

BACKGROUND OF THE INVENTION

1. Field of the Invention

The present invention relates to an electronic pad used as an electronic percussion instrument.

2. Description of Related Art

There is known hitherto a disk-shaped acoustic cymbal made of brass, phosphor bronze or the like.

FIG. 11 shows an acoustic cymbal.

This acoustic cymbal 130 has an edge portion 101 which is an outer peripheral edge portion, a bow portion 102 which is an intermediate portion and a convex cup portion 103 which is a central portion. Here, if the edge portion 101 of the acoustic cymbal is struck with a percussion member such as a stick, a tone called a crash tone having a noise component is obtained. This tone is used to put emphasis in a musical performance. Also, if the bow portion is struck, a tone so-called legato tone or ride tone is obtained. This tone is used to add rhythm to a musical performance. Further, if the cup portion 103 is struck, a tone so-called a cup tone or a bell tone having many treble components is obtained. This tone is used to add rhythm to a musical performance. In this way, different tones can be obtained from the edge portion 101, the bow portion 102 and the cup portion 103 of the acoustic cymbal 130, respectively. It is, therefore, possible to expand a performance presentation by striking the edge portion 101, the bow portion 102 and the cup portion 103 separately. However, since the acoustic cymbal of this type produces loud sound when struck with a percussion member, it is inappropriate to be used for practice in an ordinary household. Further, since the tones cannot be changed, preparation of a plurality of types (i.e., sizes, materials and shapes) of cymbals is required.

In recent years, an electronic cymbal imitating the above-stated acoustic cymbal has been widely used. This electronic cymbal detects the striking position and the striking force of a stick or the like by means of a striking sensor, controls a sound source based on the detected striking position and striking force and thereby produces a cymbal sound (electronic percussion sound). The electronic cymbal can, therefore, advantageously lower the volume of the striking sound. As the electronic cymbal of this type, there are proposed an electronic cymbal made of hard resin such as ABS and enabling a striking sound for which volume is to be lowered produced from the electronic cymbal itself and an electronic cymbal (see Japanese Patent Unexamined Application Publication No. 10-207451) made by combining two disk-shaped frames having different sizes so as to enhance a sense of performance and a performance quality. In addition, there are proposed an electronic cymbal (see Japanese Utility Model Examined Application Publication No. 4-3358) wherein a cushion material is bonded to and a striking sensor is attached to the surface of a disk-shaped metallic cymbal and a cymbal sound according to the output of the striking sensor is produced, and an electronic cymbal (see Japanese Patent Unexamined Application Publication Nos. 11-184459 and 11-272266) enabling a striking sound (or vibration sound) for which volume is to be lowered without decreasing a striking sensation by providing many small holes bored in a disk-shaped metallic cymbal and the like.

Nevertheless, the above-stated electronic cymbal formed out of hard resin disadvantageously has a problem in that the striking sensation is different from that of an acoustic cymbal. The electronic cymbal made by a combination of two disk-shaped frames is disadvantageous visually.

Furthermore, the electronic cymbal having the cushion material bonded to the surface of the disk-shaped metallic cymbal and the striking sensor attached to the surface thereof and producing a cymbal sound has disadvantages in that, for example, it is difficult to detect a striking position (region) since a vibration wave contains many high frequency components and, therefore, tones are lacking in variation. Furthermore, since the output of the striking sensor largely differs between a case where the portion right above the sensor is struck and a case where portions other than this portion are struck, the sensitivity distribution of the striking sensor appears bad, so that it is disadvantageously difficult to detect a striking force with high accuracy.

Moreover, the electronic cymbal having many small holes bored in the disk-shaped cymbal has disadvantages in that the sensitivity distribution of the striking sound is not well improved and the detection accuracy of the striking position is low, although this electronic cymbal has an improved striking sensation.

SUMMARY OF THE INVENTION

The first electronic pad among electronic pads according to the present invention, which has been made to solve the above problems, is an electronic pad receiving a strike on an upper surface, detecting the strike and outputting a signal representative of the strike, the electronic pad characterized by comprising:

a disk-shaped first frame;

a striking sensor detecting the strike transmitted to the first frame; and a second frame made of a softer material than a material for the first frame, supporting the first frame from below, having an attachment hole provided at a center and vertically penetrating the second frame, and supported by a pole of a stand supporting the electronic pad by inserting the pole into the attachment hole.

Here, in the first electronic pad, it is preferable that:

the first frame has a larger opening portion than the attachment hole of the second frame, the opening portion provided on a central portion of the first frame; and that the second frame includes a head portion having the attachment hole and inserted into the opening portion from below in an upward direction, and a shoulder portion supporting a surrounding portion of the opening portion of the first frame from below, the surrounding portion surrounding the head portion.

Further, in the first electronic pad, it is a preferable mode that the second frame has a concave portion around the attachment hole on a lower surface of the second frame, the concave portion having a trough extending in a predetermined direction and hollowed into a wedge shape, an upper surface of the concave portion has an insertion hole at a center and has such a shape as to protrude in a wedge shape having a ridge extending in the predetermined direction, the pole is inserted into the insertion hole to allow the second frame to be supported by a rotation stopper member fixed to the pole from below.

In this case, it is preferable that the concave portion is rockably fitted into the rotation stopper member with resulting play.

Also, the second electronic pad among the electronic pads according to the present invention attaining the above object is an electronic pad receiving a strike on an upper surface, detecting the strike, and outputting a signal representative of the strike, the electronic pad characterized by comprising:

a disk-shaped first frame;

a cover covering an upper surface of the first frame, having a cup portion formed on a central portion of the cover, a space formed between the cup portion and the upper surface of the first frame, the cover excluding the cup portion spreading to contact with the first frame; and a striking sensor detecting the strike transmitted to the first frame through the cover.

Here, in the second electronic pad, it is preferable that the cover has a dome-shaped core on the central portion, thereby forming the cup portion on the central portion, and the cover excluding the core being formed out of a softer material than a material for the first frame.

In addition, in the second electronic pad, it is a preferable mode that the first frame has an outer peripheral edge portion formed downward by an annulus step; and that a portion covering the outer peripheral edge portion of the cover is formed to be thick so that an upper surface of the cover becomes flat by absorbing the step.

Moreover, in the second electronic pad, it is a preferable mode that the cover has such a shape as to spread outside compared with a peripheral edge of the first frame and folded toward a rear surface side of the peripheral edge of the first frame.

Further, in the second electronic pad, it is preferable that the first frame has such a shape that a peripheral edge portion of the first frame is cut off over a predetermined angle range along a peripheral edge of the first frame; and that a portion of the cover is formed out of more material per unit length along the peripheral edge than a material for a part covering an uncut part of the peripheral edge portion, the portion covering the cut-off portion of the peripheral edge portion of the first frame.

Furthermore, in the second electronic pad, it is preferable that the striking sensor adheres to a portion of the first frame, the portion covered with the cup portion formed on central portion of the cover.

In addition, it is preferable that the second electronic pad comprises a first sheet sensor formed on the first frame, provided on a portion put between the first frame and a dome-shaped peripheral edge formed on the central portion of the cover, extending in a circumferential direction, and detecting a strike applied to the cup portion. In this case, it is also a preferable mode that the first sheet sensor extends to only a portion in a circumferential direction.

Further, it is preferable that the second electronic pad comprises a second sheet sensor provided on an upper surface of a peripheral edge portion of the first frame, and extending to only a part in a circumferential direction.

The third electronic pad among the electronic pads according to the present invention attaining the above object, is an electronic pad receiving a strike on an upper surface, detecting the strike, and outputting a signal representative of the strike, the third electronic pad characterized by comprising:

a disk-shaped first frame;

a striking sensor detecting the strike transmitted to the first frame; and a third sheet sensor provided on a lower surface of a peripheral edge portion of the first frame, extending in a circumferential direction, and detecting an operation with respect to the lower surface of the peripheral edge portion.

Here, in the third electronic pad, it is preferable that the third sheet sensor extends to only a part in the circumferential direction.

Further, the fourth electronic pad among the electronic pads according to the present invention attaining the above object is an electronic pad receiving a strike on an upper surface, detecting the strike, and outputting a signal representative of the strike; the fourth electronic pad characterized by comprising:

a disk-shaped first frame;

a cover covering an upper surface of the first frame, having a cup portion formed on a central portion, a space formed between the cover and the upper surface of the first frame, the cover excluding the cup portion spreading to contact with the first frame;

a striking sensor adhering to a portion of the first frame, the portion covered with the cup portion formed on the central portion of the cover;

a first sheet sensor formed on the first frame, provided at a portion put between the first frame and a dome-shaped peripheral edge portion formed on the central portion of the cover, and detecting a strike applied to the cup portion;

a second sheet sensor provided on an upper surface of a peripheral edge portion of the first frame, and detecting a strike applied to the peripheral edge portion; and a third sheet sensor provided on a lower surface of the peripheral edge portion of the first frame, and detecting an operation with respect to the lower surface of the peripheral edge portion.

Here, it is preferable that the fourth electronic pad comprises:

a first jack outputting signals from a channel connected to the striking sensor and from a channel connected to the first and third sheet sensors; and a second jack outputting signals from the channel connected to the striking sensor and from a channel connected to the second sheet sensor. In this case, it is preferable that the electronic pad is rockably attached to a pole around a predetermined horizontal axis; and that the first jack and the second jack are provided near the horizontal axis. It is also a preferable mode that the electronic pad comprises a second frame formed out of a softer material than a material for the first frame, supporting the first frame from below, and supported by the pole; and the first jack and the second jack are fixed to the second frame.

DETAILED DESCRIPTION OF THE INVENTION

The embodiments of the present invention will be described hereinafter.

Figure 1:
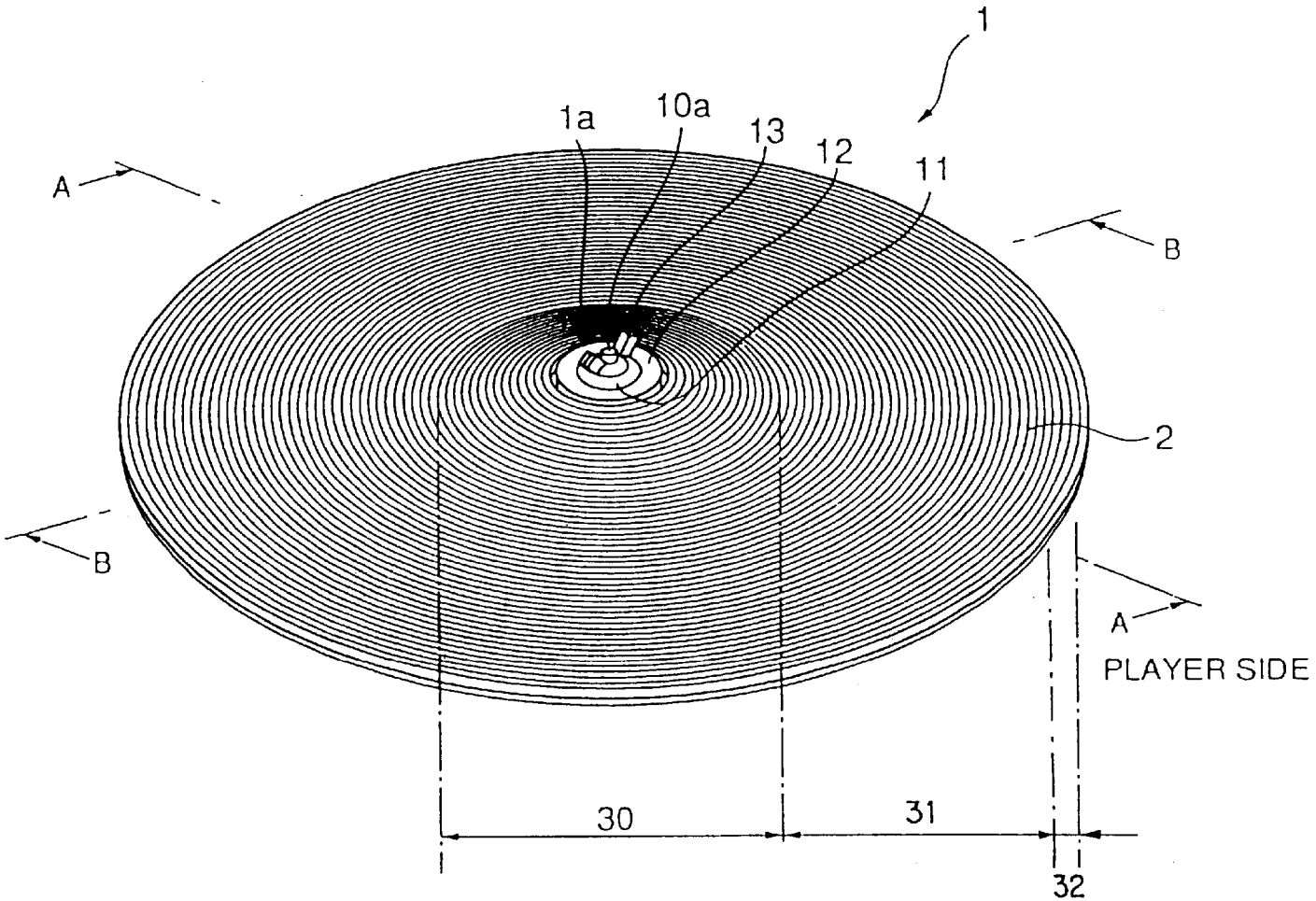
FIG. 1 is a perspective view of an electronic pad used as an electronic cymbal in the first embodiment according to the present invention.

FIG. 1 is a perspective view of an electronic pad 1 used as an electronic cymbal in the first embodiment according to the present invention.

The electronic pad 1 shown in FIG. 1 can be divided into a cup portion 30 surrounding a central opening portion 1*a* and bulging in a dome shape, an outer peripheral edge portion 32 and a bow portion 31 between the cup portion 30 and the edge portion 32.

Figure 3:
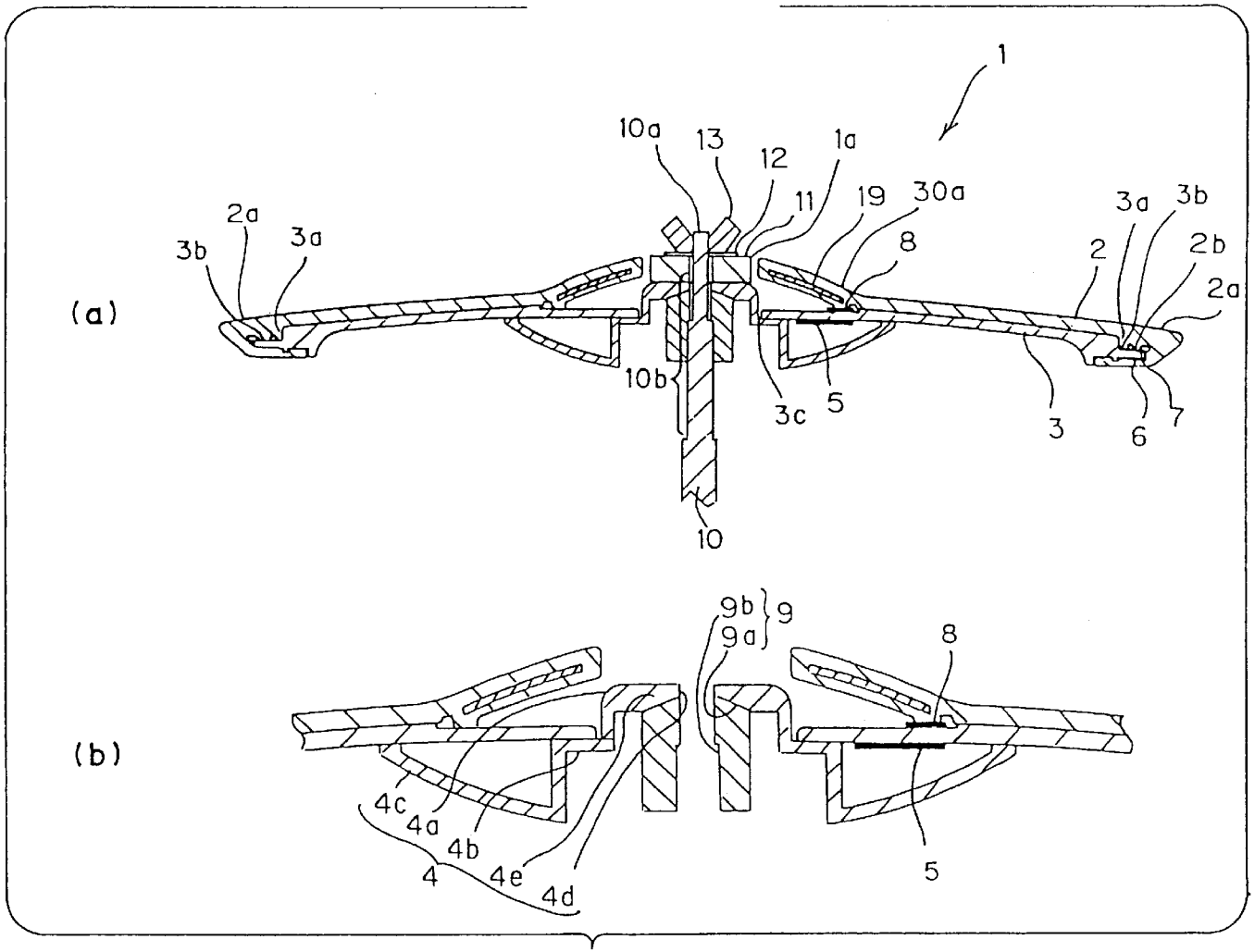
FIG. 3 is a cross-sectional view of the electronic pad, which view is taken along line A—A of FIG. 1.

The upper surface of the electronic pad 1 is covered with a cover 2. As shown in FIG. 3, a dome-shaped core 19 is formed integrally with the central portion of the cover 2 to thereby form the cup portion 30 (see FIG. 1). As a material for this cover, rubber elastomer having both elasticity which is an excellent feature of rubber and productivity which is an excellent feature of plastic, or the like is used.

Figure 2:
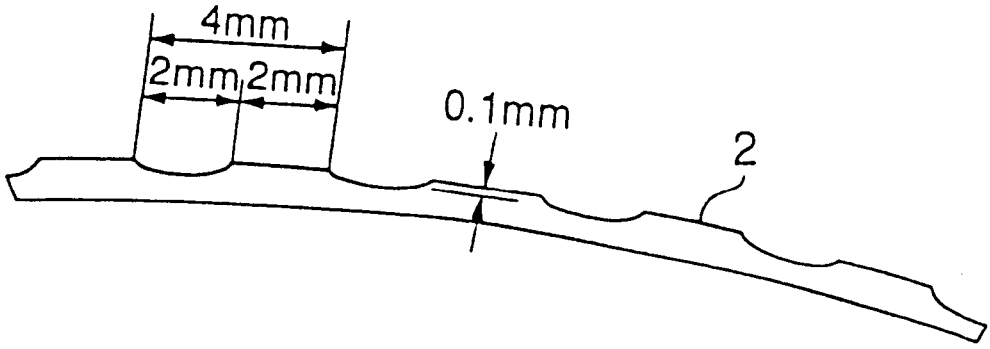
FIG. 2 shows a part of a cover covering the upper surface of the electronic pad.

FIG. 2 is a cross-sectional view showing a part of the cover 2 covering the upper surface of the electronic pad 1.

Concentric irregularity processing is conducted to the upper surface of the cover 2 covering the upper surface of the electronic pad 1. Through this processing, irregularities having, for example, a groove width of 2 mm, a pitch of 4 mm (2 mm between grooves) and a depth of 0.1 mm are formed on the upper surface of the cover 2.

Further, a coating treatment is applied to the upper surface of the cover 2 to coat rubber primer onto the upper surface thereof by dipping, brushing, spraying or the like, whereby the surface of the cover 2 has a low friction factor and improved abrasion resistance. As a result, a stick slides on the electronic pad 1 similarly to a case where a metallic acoustic cymbal is struck with the stick and the abrasion of the rubber after the electronic pad 1 is struck with sticks for a long period of time can be decreased. This cover 2 may be formed out of a material having the same advantage as the above-stated surface treatment and softer than the first frame 3 to be described later. In addition, the surface treatment such as the coating of rubber primer stated above is applied to a sliding portion 2*b* pressing an edge upper portion sheet sensor 7 and a portion supporting an edge lower portion sheet sensor 6 from below on the rear surface of the outer peripheral edge portions 2*a* of the cover 2 so as to prevent abrasion. By covering the first frame 3 with the cover 2, the upper surface of the electronic pad 1 enables a stick to have good bounce.

The screw portion 10*a* of a pole 10 supporting the electronic pad 1 from below, a wing nut 13 screwed with the screw portion 10*a*, a metallic washer 12 and felt washer 11, which will be described later, are shown in this order from above on the central opening portion 1*a* of the electronic pad 1.

FIG. 3 is a cross-sectional view of the electronic pad 1 shown in FIG. 1, which view is taken along line A—A of FIG. 1. FIG. 3(*b*) is an enlarged view showing the neighborhood of the center of FIG. 3(*a*) excluding the pole 10, the wing nut 13, the metallic washer 12 and the felt washer 11 for convenience sake. The first frame 3 is made of a hard material and has an opening portion 3*c* at the center thereof. The upper surface and the lower side of the peripheral edge portions of the first frame 3 excluding the upper surface of the central opening portion 3*c* are covered with the cover 2. ABS, polycarbonate or the like is used as a material for the first frame.

The first frame 3 also has an outer peripheral edge portion 3*b* having an annulus step 3*a* constituting the outer periphery of the first frame 3 and formed downward. The outer peripheral edge portion 2*b* of the cover 2 contacting with the outer peripheral edge portion 3*b* of the first frame 3 is formed to be thicker by as much as the step 3*a*, whereby the upper surface of the portion contacting with the step 3*a* is formed flat. That; is, the upper surface of the electronic pad 1 is formed in such a shape as not to appear as if the step 3*a* is present. By thus forming the step 3*a*, the first frame 3 has uniform vibration and the outer peripheral edge portion 3*b* is suppressed from vibrating. Accordingly, vibration attenuates relatively promptly, so that even if this electronic pad 1 is continuously struck, it is possible to accurately detect the striking position and the striking force for each strike. Besides, the appearance of the upper surface is similar to that of the acoustic cymbal, ensuring a good striking sensation.

Further, since the outer peripheral edge portion 2*a* is formed to be spread outside compared with the outer peripheral edge portion 3*b* of the first frame 3, the edge portion 32 tends to be deformed when struck. As a result, it is possible to reproduce a feeling that the edge portion of the acoustic cymbal is deformed to absorb impact.

FIG. 3(*b*) shows the second frame 4. The second frame 4 consists of a head portion 4*a* protruding upward from the central opening portion 3*c* of the first frame 3, a shoulder portion 4*b* supporting the lower peripheral edge of the opening portion 3*c* from below and an arm portion 4*c* supporting the lower surface of a region corresponding to the bow portion 31 shown in FIG. 1 from below.

An attachment hole 4*d* vertically penetrating the second frame 4 is provided at the center of the head portion 4*a* of the second frame 4 as shown in FIG. 3(*b*). Also, a concave portion 4*e* fitted into a rotation stopper member 9 to be described later and hollowed in a wedge shape with a trough extending in a predetermined direction is provided around the attachment hole 4*d*. A softer material, such as rubber, than the material for the first frame 3 is used for the second frame 4.

FIG. 3 also shows a piezoelectric sensor 5 provided on the lower surface of the first frame 3, covered with the arm portion 4*c* of the second frame 4 and contacting with a player side. This piezoelectric sensor 5 detects the struck surface of the electronic pad and a strike against the peripheral edge of the struck surface.

In this case, since the portion of the first frame 3 provided with the piezoelectric sensor 5 is covered with the dome-shaped portion of the cover 2, it is possible to prevent the portion right above the piezoelectric sensor 5 from being directly struck with a stick. Accordingly, the magnitude of a signal outputted from the piezoelectric sensor 5 is not largely changed according to the struck position and the piezoelectric sensor 5 has good sensitivity distribution characteristics, thereby further enhancing detection accuracy for a striking force and striking position.

It is assumed that this electronic pad 1 is struck only on the right half thereof. In FIG. 3, the piezoelectric sensor 5, and an edge upper portion sheet sensor 7, an edge lower portion sheet sensor 6 and a cup portion sheet sensor 8 to be described later are provided only on substantially the right half but not on the left half thereof.

To be specific, the cup portion sheet sensor 8 is provided to spread over about ⅔ of the upper surface of the peripheral edge portion of the opening of the first frame 3 covered with the cover 2 (at 120 degrees left and right relative to a player's position, respectively). The edge upper portion sheet sensor 7 and the edge lower portion sheet sensor 6 are provided to spread about ⅓ of the outer peripheral edge portion of the first frame 3 (at 60 degrees right and left relative to the player's position, respectively).

Here, the concave portion 4*e* of the second frame 4 and the rotation stopper member 9 are fitted into each other to prevent the rotation of the electronic pad 1, thereby making it possible to restrict a striking range.

By thus restricting the striking range, it is possible to dispense with a sensor to be provided out of the striking range and to thereby decrease manufacturing cost.

Figure 6:
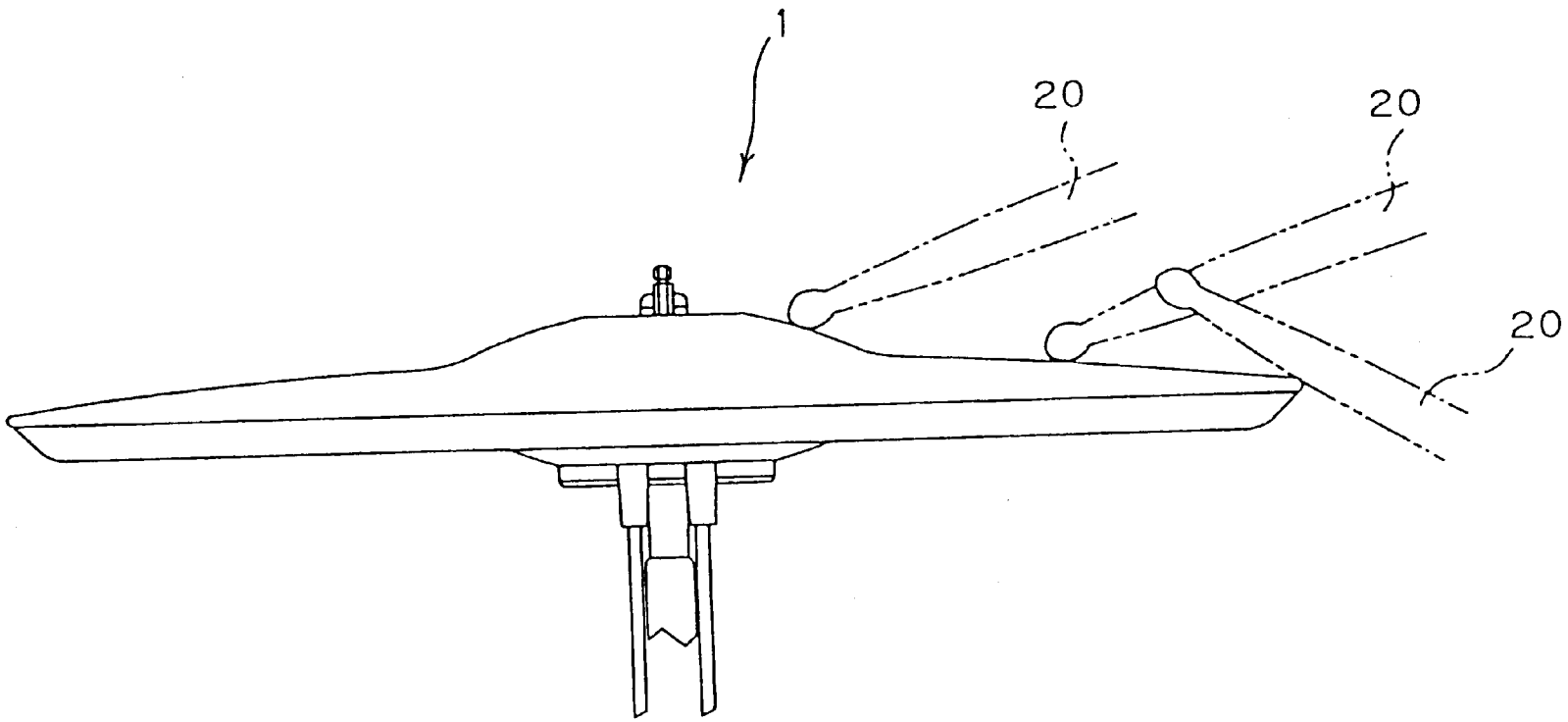
FIG. 6 is a conceptual view showing a state in which the electronic pad is struck.

It is noted that the circumferential angle (120 degrees right and left, respectively) of the cup portion sheet sensor 8 is wider than those of the edge upper portion sheet sensor 7 and the edge lower portion sheet sensor 6. This is because the sensor must deal with a case where the electronic pad 1 is struck by a portion near the center of the stick 20 from a lateral direction in addition to a case where the electronic pad 1 is struck by the tip portion (tip end portion) of the stick 20 from longitudinal direction as shown in FIG. 6.

In this embodiment, description has been given to a case where the cup portion sheet sensor 8 is provided to spread about ⅔ of the upper surface of the peripheral portion of the opening. This is intended to reduce cost and the cup portion sheet sensor 8 may be provided on the entire periphery on the upper surface of the opening peripheral edge portion.

Here, the second frame 4 is formed out of a softer material, such as rubber, than that of the first frame 3 as already described above and structured so that the shoulder portion 4*b* supports the first frame 3. The second frame 4 is, therefore, fixed to the pole 10 of a stand to be described later. As a result, the first frame 3 is not fixed to the stand and vibration generated at the first frame 3 is smoothly propagated onto the first frame 3. Thus, the piezoelectric sensor 5 can accurately detect vibration generated at the first frame 3 after the surface and the peripheral edge of the surface of the electronic pad 1 are struck.

Further, the cover 2 is provided to cover even the lower side of the outer peripheral edge portion 3*b* of the first frame 3. The edge lower portion sheet sensor 6, which is one example of an operation sensor according to the present invention, is provided between the lower surface of the outer peripheral edge portion 3*b* of the first frame 3 and the cover 2 provided on the lower side of this outer peripheral edge portion. This edge lower portion sheet sensor 6 detects pressure generated by the silencing operation of the player but does not detect a strike.

Furthermore, the edge upper portion sheet sensor 7 is provided between the upper surface of the outer peripheral edge portion 3*b* of the first frame 3 and the cover 2 covering the upper surface of this outer peripheral edge portion 3*b*. This edge upper portion sheet sensor 7 detects pressure generated by the striking of the outer peripheral edge portion 32 shown in FIG. 1 or the like. In addition, the cup portion sheet sensor 8 is provided at a position at which the bottom 30*a* of the cup portion 30 at the center of the electronic pad 1 is proximate to the first frame 3 to contact with the upper surface of the first frame 3.

The cup portion 30 of the electronic pad 1 shown in a dome shape in FIG. 2 is formed out of the cover 2 integrally formed with the core 19. If the cup portion 30 is struck, the peripheral edge portion of the core 19 presses the cup portion sheet sensor 8 through the inner surface of the peripheral edge portion of the cup portion 30 of the cover 2. As a result, this cup portion sheet sensor 8 detects a strike against the cup portion 30.

As already stated above, the concave portion 4*e* formed to be hollowed in a wedge shape and having a trough spread in a predetermined direction is formed on the central lower surface of the head portion 4*a* of the second frame 4. On the other hand, as shown in FIG. 3(*b*), the rotation stopper member 9 has a tip end portion 9*a* fitted into the concave portion 4*e*, having a ridge in a predetermined direction and protruding in a wedge shape.

Further, the rotation stopper member 9 has a penetrating hole 9*b*, as shown in FIG. 3(*b*), through which the pole 10 supporting the electronic pad 1 enters from below. This penetrating hole 9*b* is formed such that the diameter thereof is reduced once on the way from lower to upper directions.

Meanwhile, this pole 10 has a tip end portion 10*b* formed to be fitted into the penetrating hole 9*b*, i.e., formed to have a reduced diameter on the way to the tip end. The rotation stopper member 9 is fixed to the pole 10 by a fastener 15 shown in FIG. 3 in a state in which the tip end portion 10*b* of the pole 10 is penetrated into the rotation stopper member 9.

Furthermore, a screw portion 10*a* is provided on the very tip end of the pole 10. The screw portion 10*a* protrudes upward, compared with the upper surface of the head portion 4*a* of the second frame 4 and screwed with the wing nut 13 while the head portion 4*a* of the second frame 4, the felt washer 11 and the metallic washer 12 are put between the screw portion 10*a* and the rotation stopper member 9. The electronic pad 1 is fixed to the pole 10 by the wing nut 13.

In other words, the electronic pad 1 is supported by the pole 10 fixing the rotation stopper member 9 having the tip end portion 9*a* fitted into the concave portion 4*e* of the second frame 4, from below.

Here, since the concave portion 4*e* of the second frame 4 is fitted into the tip end portion 9*a* of the rotation stopper member 9, the rotation of the electronic pad 1 about the pole 10 as a rotary shaft is prevented. This can prevent the output cable 14 of the electronic pad 1 to be described later from being entwined about the pole 10 and being pulled by the pole 10.

Figure 4:
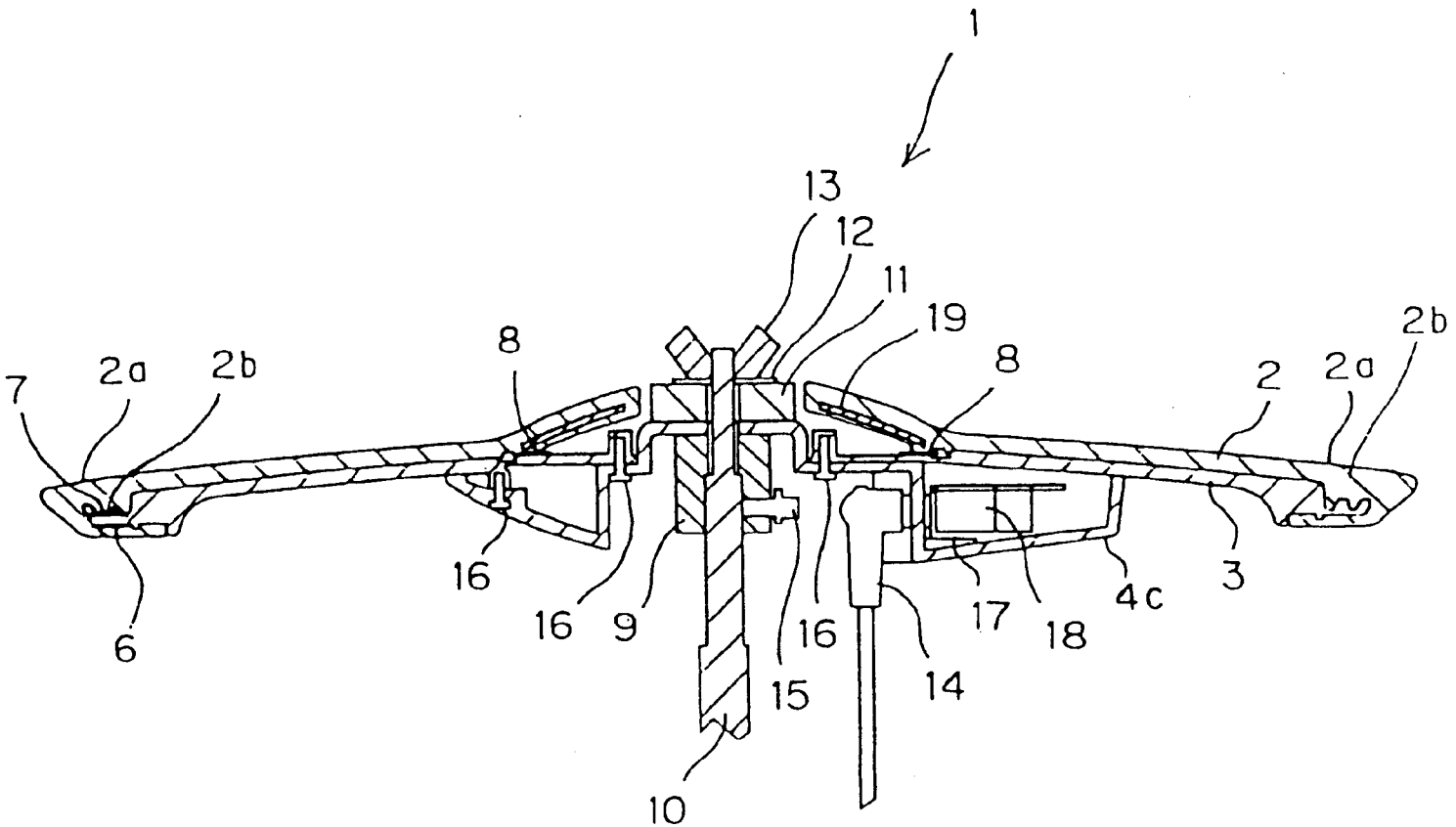
FIG. 4 is a cross-sectional view of the electronic pad, which view is taken along line B—B of FIG. 1.

FIG. 4 is a cross-sectional view of the electronic pad 1 shown in FIG. 1, which view is taken along line B—B of FIG. 1.

FIG. 4 shows the above-stated fastener 15 for fixing the rotation stopper member 9 to the pole 10 and a screw 16 for fixing the second frame 4 to the first frame 3. In FIG. 4, the cup sheet sensor 8 is provided on each of the right and left sides of the electronic pad 1. The reason is as follows. The cross-sectional view of FIG. 4 differs from that of FIG. 3 by 90 degrees and illustrates a cross section if this electronic pad 1 is viewed from a player's position.

Further, FIG. 4 shows an output jack 18 and an output cable 14 for transmitting respective output signals from the piezoelectric sensor 5, the edge lower portion sheet sensor 6, the edge upper portion sheet sensor 7 and the cup portion sheet sensor 8 to a sound generating device which is not shown.

The output jack 18 is provided in a space between the arm portion 4*c* of the second frame 4 and the lower surface of the first frame 3 and fixed to the second frame 4 through an output jack holder 17. Since the second frame 4 is formed out of a softer material, such as rubber, than that of the first frame 4 as already stated above, the second frame 4 is slightly deformed by pulling the output cable 14 or by the vibration of the electronic pad 1, thereby preventing the output jack and the like from being broken. This output jack 18 consists of two jacks, i.e., the first output jack 110 and the second output jack 120 (see FIG. 8). Output signals from the respective sensors stated above are outputted from the first output jack 110 and the second output jack 120, passed through the output cable 14 and transmitted to the sound generating device which is not shown. In this embodiment, although the number of sensors differs from the number of terminals, the signals from the respective sensors can be transmitted to the sound generating device, which will be described later.

Figure 5:
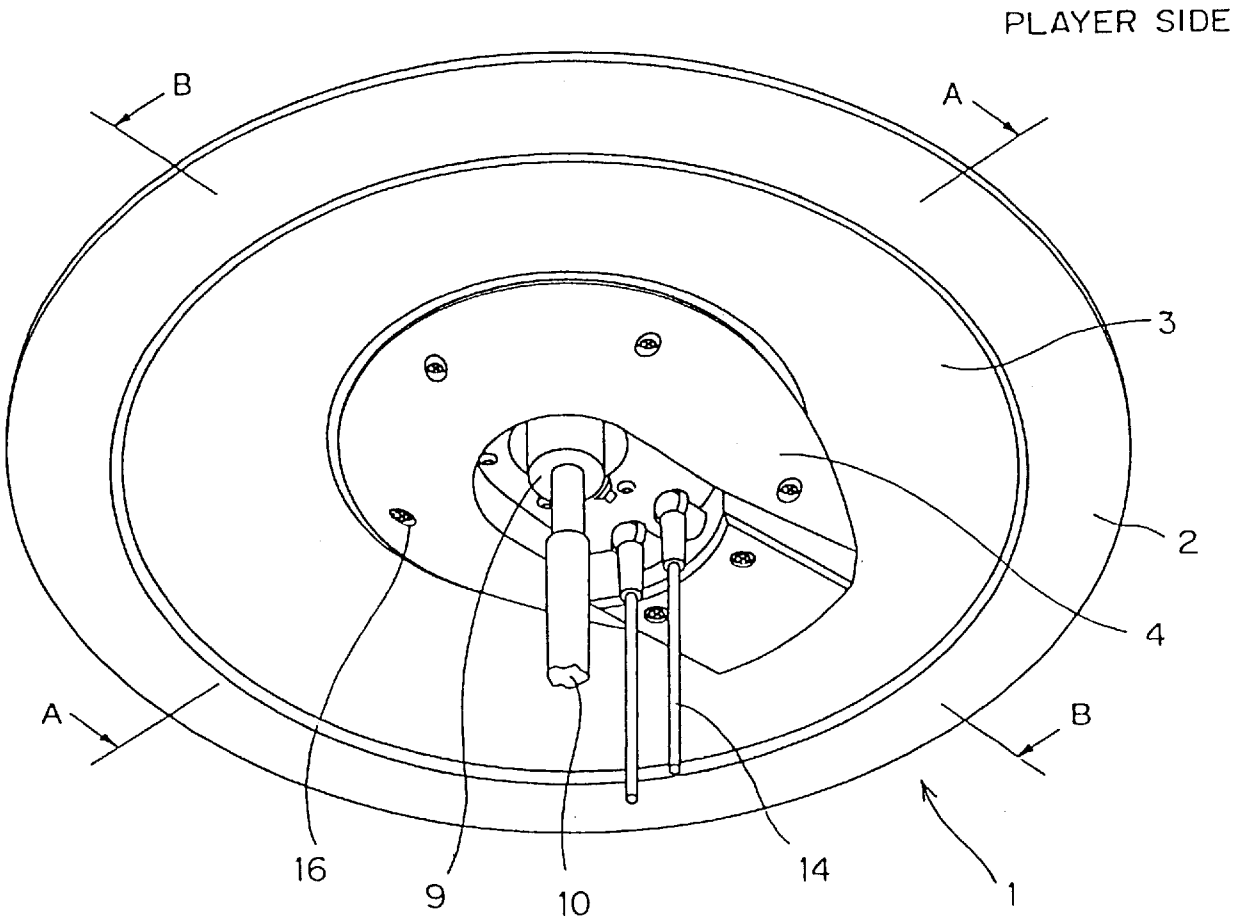
FIG. 5 is a perspective view showing the electronic pad from obliquely downward direction.

FIG. 5 is a perspective view showing the electronic pad 1 from an obliquely downward direction. FIG. 5 shows the cover 2 provided to spread over the lower side to encompass the outer peripheral edge of the first frame 3 as stated above. FIG. 5 also shows a state in which the electronic pad 1 is supported by the pole 10 to which the rotation stopper member 9 is fixed. As shown in FIG. 5, the second frame 4 is fixed to the lower surface of the first frame 3 on several portions by screws 16.

Figure 7:
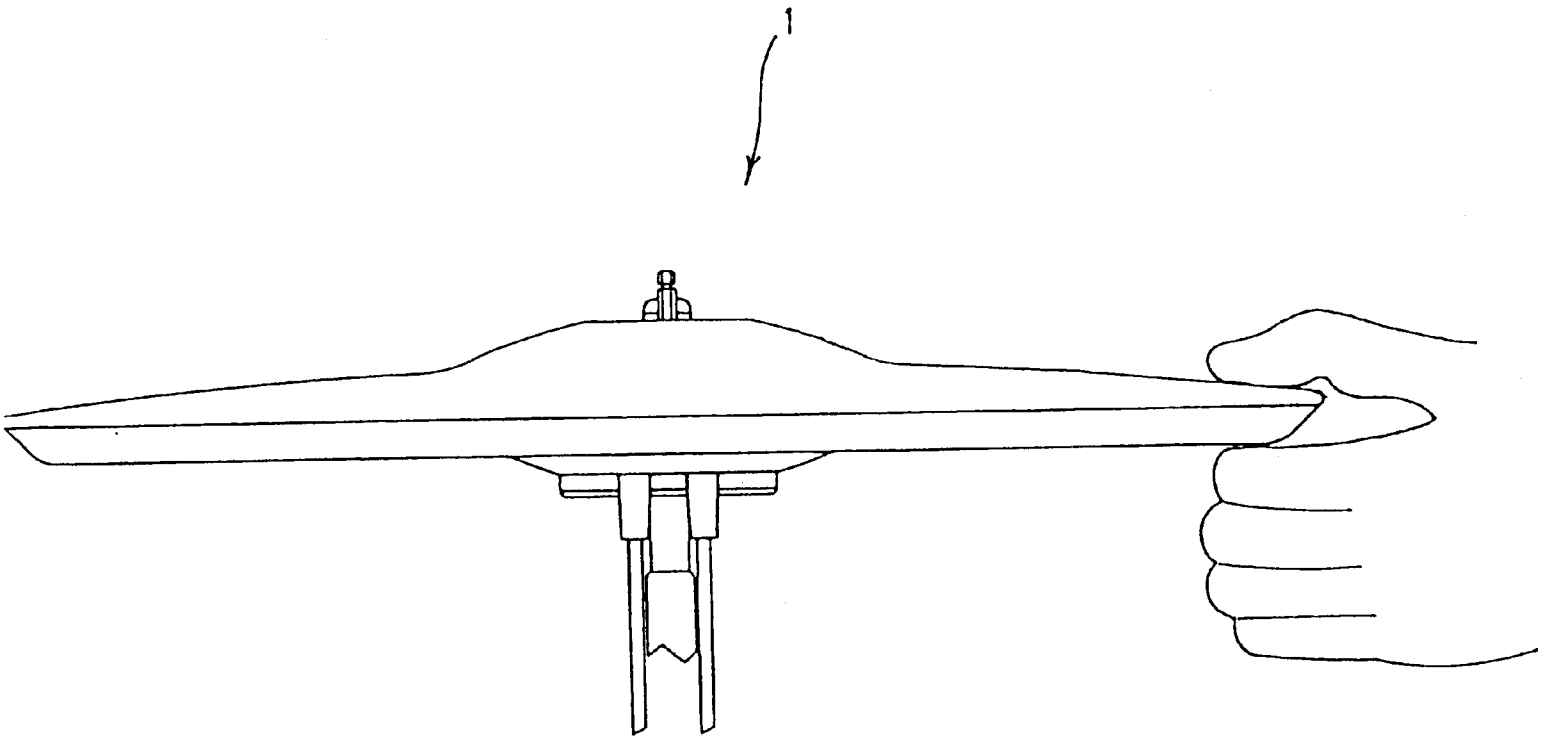
FIG. 7 is a conceptual view showing a state in which the outer peripheral edge portion of the electronic pad is nipped with fingers to perform a silencing operation.

FIG. 6 is a conceptual view showing that the cup portion 30 at the center of the electronic pad 1 shown in FIG. 1, the bow portion 31 at the intermediate position thereof and the edge portion 32 on the outer peripheral edge thereof are struck with the stick 20, respectively. FIG. 7 is a conceptual view showing a state in which a silencing operation is performed by nipping the outer peripheral edge of the electronic pad 1 with fingers.

Here, if the strike or the silencing operation shown in FIGS. 6 and 7 are conducted to the electronic pad 1, the piezoelectric sensor 5, the edge lower portion sheet sensor 6, the edge upper portion sheet sensor 7 and the cup portion sheet sensor 8, shown in FIG. 3, detect vibration and pressure. Output signals from the respective sensors are combined by a circuit shown in FIG. 8, outputted from the output jack 18, i.e., the first output jack 110 and the second output jack 120, passed through the output cable 14 and transmitted to the sound generating device which is not shown.

The sound generating device stores tones imitating the typical tones of the respective regions produced from an acoustic cymbal and outputted, i.e., a so-called cup tone, a so-called bow tone and a so-called edge tone if the regions of the acoustic cymbal corresponding to the cup portion 30 at the center of the electronic pad 1, the bow portion 31 at the intermediate position thereof and the edge portion 32 on the outer peripheral edge thereof shown in FIG. 1 are struck. Based on the combination of the output signals transmitted through the output cable 14, the sound generating device produces tones corresponding to the struck regions or silences the tones.

Next, description will be given to the correspondence among the outputs of the respective sensors, the striking positions and the silencing operation (the choke of the edge portion). Table 1 shows the correspondence.

TABLE 1

| | Piezo-electric sensor | Cup portion sheet sensor | Edge upper portion sheet sensor | Edge lower portion sheet sensor |
|---|---|---|---|---|
| Performance on cup portion | Output | ON | OFF | OFF |
| Performance on bow portion | Output | OFF | OFF | OFF |
| Performance on edge portion | Output | OFF | ON | OFF |
| Choke of edge portion | No output | OFF | ON | ON |

The piezoelectric sensor 5 outputs a signal if any of the cup portion 30, the bow portion 31 and the edge portion 32 shown in FIG. 1 is struck and the sensor 5 is turned off when choking the edge portion. Also, the cup portion sheet sensor 8 is turned on only when the cup portion 30 is struck. The edge upper portion sheet sensor 7 is turned off while a player is performing on the electronic pad 1 using the cup portion 30 and the bow portion 31, and the sensor 7 is turned on when striking the edge portion 32 and when choking the edge portion.

The edge lower portion sheet sensor 6 is turned on only when choking the edge portion. That is to say, the edge lower portion sheet sensor 6 does not react to strike and only detects an operation carried out to the peripheral edge portion of the electronic pad 1, i.e., the choke of the edge portion.

Figure 8:
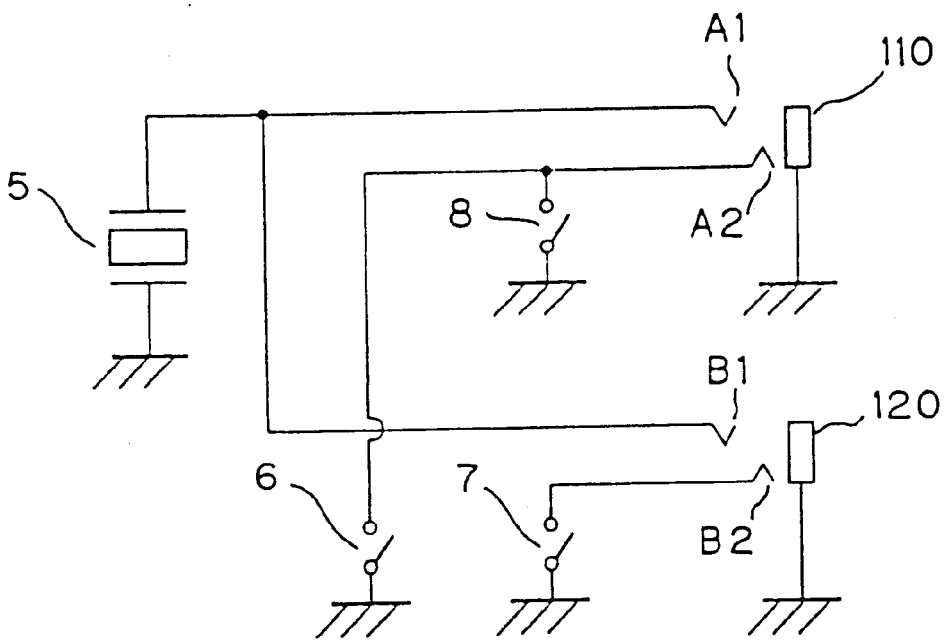
FIG. 8 is a wiring diagram of a jack section for transmitting an output signal from each sensor to a sound source.

FIG. 8 is a wiring diagram of the jack portion for transmitting output signals from the respective sensors to a sound source.

FIG. 8 shows two terminals A1 and A2 connected to the first output jack 110 and two terminals B1 and B2 connected to the second output jack 120. Output signals from the piezoelectric sensor 5 are transmitted to both the terminal A1 and terminal B1. The edge lower portion sheet sensor 6 and the cup portion sheet sensor 8 are connected to the terminal A2. However, as shown in Table 1, there is not timing at which both the edge lower portion sheet sensor 6 and the cup portion sheet sensor 8 are turned on simultaneously. Besides, it is possible to determine which is turned on, the edge lower portion sheet sensor 6 or the cup portion sheet sensor 8, by checking the output of the piezoelectric sensor 5. Accordingly, output signals from both the edge lower portion sheet sensor 6 and the cup portion sheet sensor 8 can be outputted from the terminal A2.

Further, the edge upper portion sheet sensor 7 is connected to the terminal B2 of the second output jack 120.

Table 2 shows the correspondence between outputs from the respective terminals and assigned tones.

TABLE 2

| Input | Terminal | Assigned tone | Sound producing condition (sensor output) | Silencing condition (sensor output) |
|---|---|---|---|---|
| First output jack | A1 | Bow tone | Piezoelectric sensor only | Edge lower portion sheet sensor only |
| | A2 | Cup tone | Piezoelectric sensor + cup | |

TABLE 2-continued

| Input | Terminal | Assigned tone | Sound producing condition (sensor output) | Silencing condition (sensor output) |
|---|---|---|---|---|
| | | | portion sheet sensor | |
| Second output jack | B1 | Toneless | Piezoelectric sensor only | Edge upper portion sheet sensor only |
| | B2 | Edge tone | Piezoelectric sensor + edge upper portion sheet sensor | |

In this case, only the first output jack 110 or only the second output jack 120 can be connected to the sound generating device. If only the first output jack 110 is connected, the sound generating device produces a cup tone and a bow tone and silence tones. If only the second output jack 120 is connected, the sound generating device produces only an edge tone and silence tones.

If the output signal of the piezoelectric sensor 5 is outputted from the terminal A1 of the first output jack 110 and no signal is outputted from the terminal A2 of the first output jack 110, a bow tone is assigned as a produced tone. If signals are outputted from both the terminals A1 and A2 of the first output jack 110, a cup tone is assigned. If the output signal of the piezoelectric sensor 5 is not outputted from the terminal A1 of the first output jack 110 and outputted from the terminal A2 thereof (in this case, the edge upper portion sheet sensor 6 is turned on), then silencing operation is performed.

Further, if a signal is outputted from the terminal B1 of the second output jack 120 and no signal is outputted from the terminal B2 thereof, then none of the tones are produced and silence is maintained. If signals are outputted from both the terminals B1 and B2, an edge tone is produced. Further, if no signal is outputted from the terminal B1 and a signal is outputted from the terminal B2, i.e., the edge upper portion sheet sensor 7 is turned on, then a silencing operation is performed. At this moment, a combination of the output of the piezoelectric sensor 5 and that of the edge upper portion sensor 7 can instantly detect a silencing operation (edge choking) without using the edge lower portion sheet sensor 6. It is noted, however, that the electronic pad 1 requires, as a whole, the edge lower portion sheet sensor 6 which detects the choke of the edge portion but does not detect a strike, so as to instantly detect a silencing operation (the choke of the edge portion).

As can be seen from the above, if the cup portion 30 of the electronic pad 1 shown in FIG. 1 is struck, signals are transmitted from the respective terminals of the terminals A1, A2 and B1 to the sound generating device and the sound generating device produces a cup tone. Likewise, if the intermediate bow portion 31 is struck, signals are transmitted from both the terminals A1 and B1 to the sound generating device and the sound generating device produces a bow tone. If the edge portion 32 on the outer peripheral edge of the electronic pad 1 is struck, signals are transmitted from the terminals A1, B1 and B2 to the sound generating device and the sound generating device produces an edge tone. As shown in Table 2, when an edge tone is produced, a bow tone is produced as well. The edge tone is often used for emphasis and the volume thereof is set large while the bow tone is masked by the edge tone and the edge tone inherently includes the feature of the bow tone. Due to this, even if the bow tone is overlapped with the edge tone and produced, the influence is almost negligible. If the sound generating device stated above produces an edge tone, the emission of the bow tone may be controlled.

Moreover, as shown in FIG. 7, by performing an operation for nipping the peripheral edge of the struck surface of the electronic pad 1 with fingers (the choke of the edge portion), the signals of the edge lower portion sheet sensor 6 and the edge upper portion sheet sensor 7 are transmitted from the terminals A2 and B2 to the sound generating device and the sound generating device performs a silencing operation.

Furthermore, the sound generating device monitors not only the presence and absence of the output of the piezoelectric sensor 5 but also the magnitude of the output signal of the piezoelectric sensor 5. To produce the above-stated respective tones, the sound generating device generates the respective tones with volumes according to the magnitude of the output signal of the piezoelectric sensor 5. Normally, a sheet sensor detects on/off states as in the case of a switch. Compared with a conventional method or the like for allowing a piezoelectric sensor or the like to monitor vibration resulting from a strike and to determine a striking position and then for selecting a tone, a method in which a sheet sensor is used and whether or not the sheet sensor is turned on is monitored enables faster tone selection. In this embodiment, the sheet sensors are used and, therefore, it is possible to produce tones such as a cup tone used for emphasis, i.e., tones required to be produced promptly for a musical performance, the above-stated edge, tone and the like. In this case, after the sound generating device promptly starts producing the tone with a certain volume, the sound generating device carries out an envelope processing to make the volume correspond to a striking sound.

As can be seen, in this embodiment, tones corresponding to struck regions such as the struck surface and peripheral edge of the struck surface of the electronic pad 1 are produced with a volume corresponding to a striking force, and the tone which is being produced is promptly silenced by the silencing operation shown in FIG. 7, compared with a conventional method.

Even if only the first output jack 110 out of the first output jack 110 and the second output jack 120 is connected to the sound generating device, the edge lower portion sheet sensor 6 provided at a position at which the sensor does not react to a strike may be turned on by the silencing operation. By doing so, a player can promptly silence a cup tone and a bow tone which are being produced compared with a conventional method.

Figure 9:
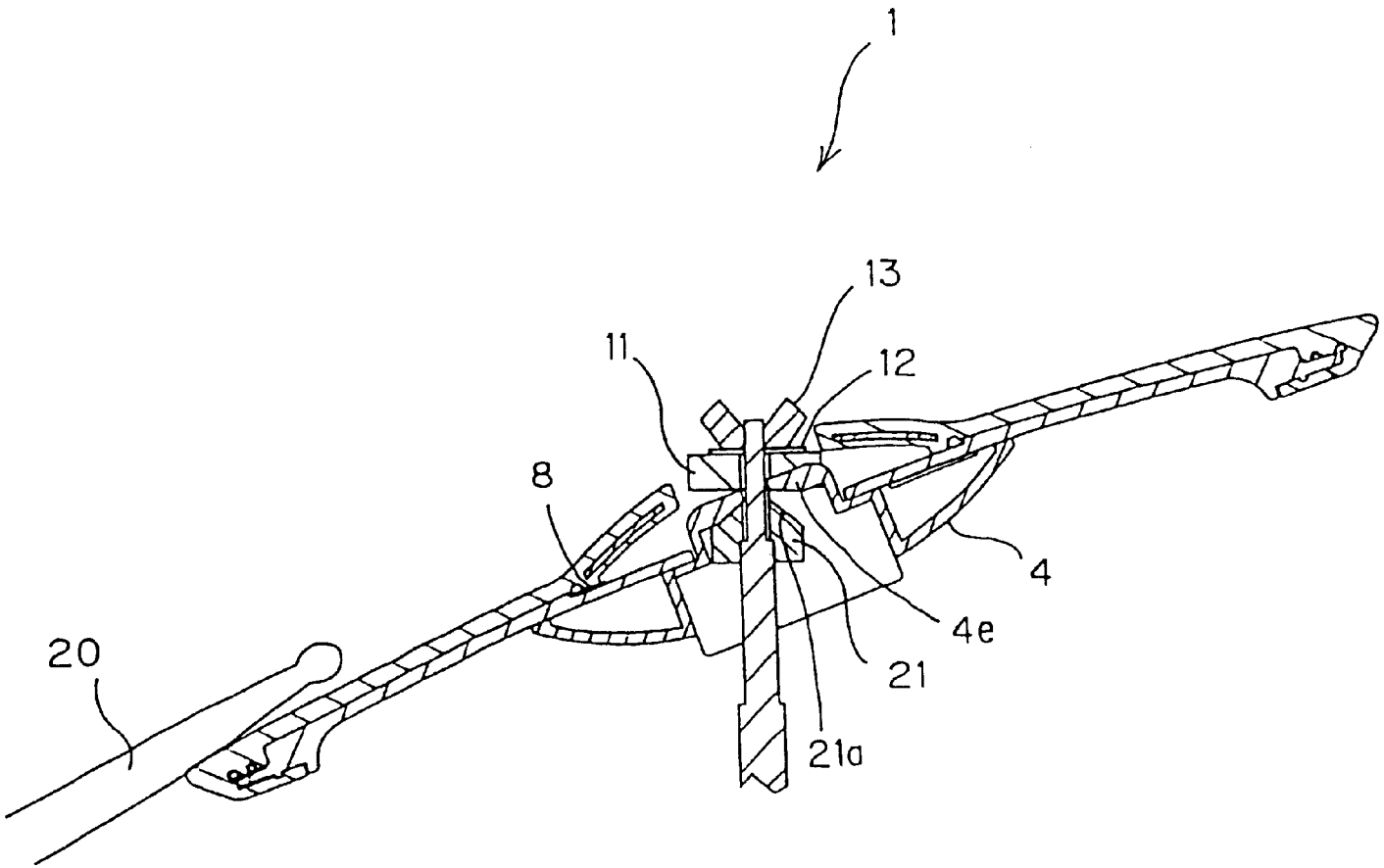
FIG. 9 shows a state in which an electronic pad having a tip end portion employing a sharper rotation stopper member than a rotation stopper member shown in FIG. 1 is struck and inclined.

FIG. 9 shows a state in which the electronic pad 1 supported by the pole 10 is struck with the stick 20 and inclined. The rotation stopper member 21 shown in FIG. 9 has a sharper wedge-shaped tip end portion 21*a* than the rotation stopper member 9 shown in FIG. 3. Due to this, the wedge shape of the tip end portion 21*a* of the rotation stopper member 21 is not completely fitted into the concave portion 4*e* of the second frame 4, i.e., there is some play. As a result, as shown in FIG. 9, when being struck, the electronic pad 1 is easily inclined.

As stated above, a plurality of types of rotation stopper members having different wedge angles are prepared and used depending on the magnitude or weight of an acoustic cymbal imitated by the electronic pad 1, whereby it is possible to adjust the degrees of vibration resulting from a strike and differing cymbals and to perform on the electronic pad similarly to the acoustic cymbal while preventing the rotation of the struck surface. Besides, it is possible to adjust the degree of vibration according to the degree at which the wing nut 13 of the screw portion 10*a* of the pole 10 is fastened.

Alternatively, the rotation member is fixed to one type capable of sufficiently vibrating and a spacer, an adapter or the like is used to adjust the gap between the rotation stopper member and the concave portion 4*e* of the second frame 4. By doing so, it is possible to perform on the electronic pad 1 similarly to the acoustic cymbal which the electronic pad 1 is to imitate, while preventing the rotation of the struck surface.

In addition, the central axis of the vibration of the electronic pad 1 generated when the electronic pad 1 is struck is present in a cross section taken along line B—B as shown in FIG. 4. In this embodiment, since the output jack 18 is arranged in the vicinity of the central axis of this vibration, the vertical movement of the output cable 14 followed by the vibration can be suppressed. Accordingly, it is possible to prevent applying overload to the output cable 14 itself caused by the weight of the output cable and to a region to which the output cable 14 is connected and to, therefore, expand the life of the electronic pad 1.

Next, the second embodiment according to the present invention will be described.

Figure 10:
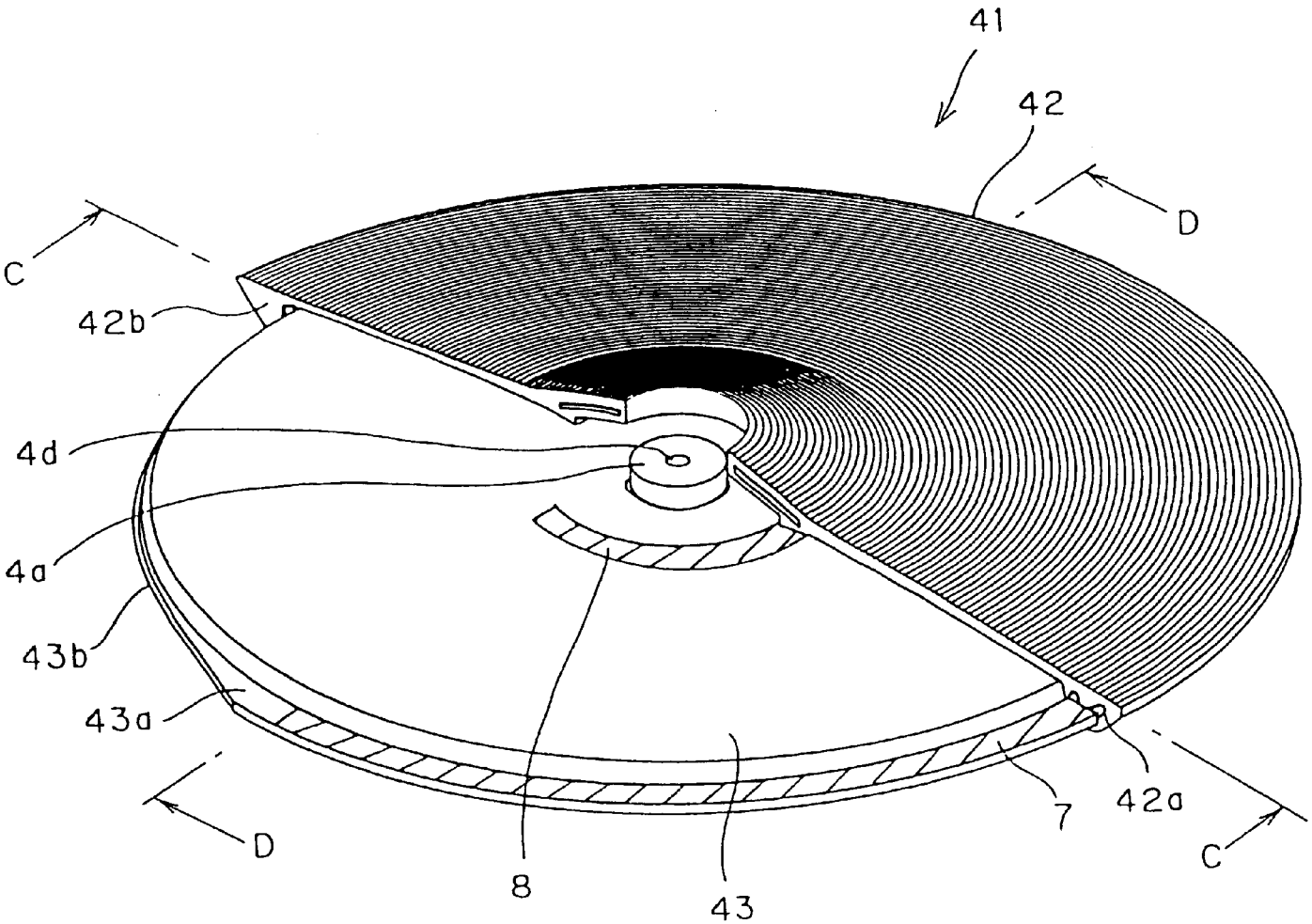
FIG. 10 shows an electronic pad in the second embodiment according to the present invention and showing a state in which a part of the outer peripheral edge portion of a frame is cut off and that the left half of a cover covering the upper surface of this frame is cut out.
Figure 11:
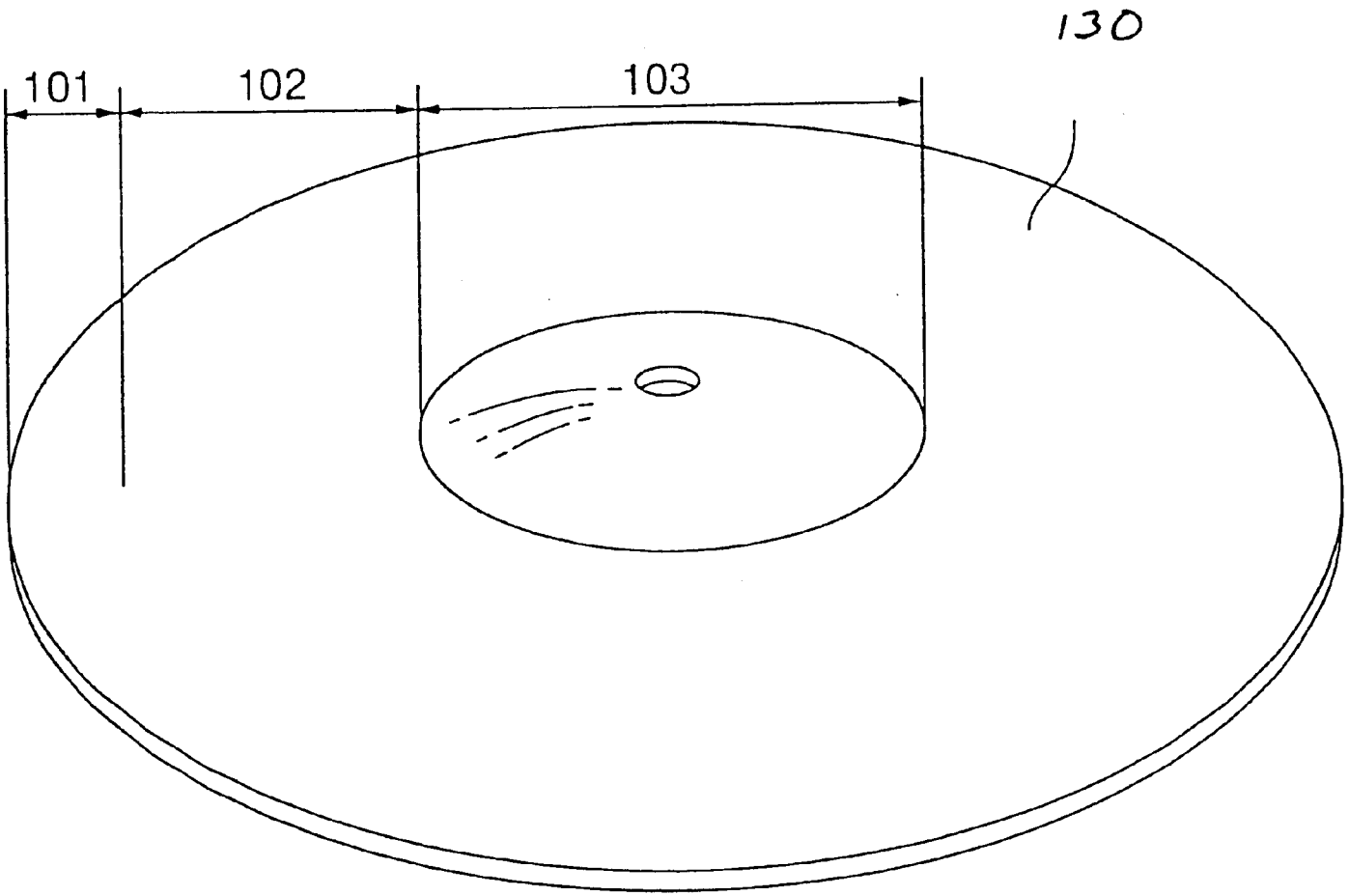
FIG. 11 shows an acoustic cymbal.

FIG. 10 shows an electronic pad 41 used as the second embodiment according to the present invention. FIG. 10 shows a frame 43 and a cover 42 covering the upper surface of the frame 43. The left half of the cover 42 is removed so that the characteristic portions of the frame 43 to be described later can be easily recognized. An outer peripheral edge portion 43*a* similar to the electronic pad 1 is provided on the outer peripheral edge of the frame 43 of the electronic pad 41. A part 43*b* of the outer peripheral edge portion 43*a* which part avoids a player's striking range is formed to be cut off as shown in FIG. 10.

A part 42*b* of the outer peripheral edge portion 42*a* of the cover 42 is closely attached to this part 43*b*. Due to this, the part 42*b* of the cover 42 is formed into such a shape packed with a space corresponding to the part 43*b* obtained by partially cutting off the frame 43.

The electronic pad 41 differs from the electronic pad 1 shown in FIG. 1 only in two respects, i.e., that a part of the outer peripheral edge portion 43*a* of the frame 43 is cut off as stated above and that the shape of a part of the outer peripheral edge portion 42*a* of the cover 2 is changed. Accordingly, a protruding head portion 4*a* of the second frame 4 at the center of the electronic pad 41, a penetrating hole 4*d* thereof and a cup portion sheet sensor 8 close to the center on the frame 43 shown in FIG. 10 as well as an edge upper portion sheet sensor 7 on the outer peripheral edge portion 43*a* of the frame 43 and the like are the same in type as those used and shown in FIG. 3. Although not shown in FIG. 10, an edge lower portion sheet sensor 6 is provided on the lower surface of the outer peripheral edge portion 43*a* of the frame 43 as in the case of the electronic pad 1 shown in FIG. 1.

Arrows C—C and D—D shown in FIG. 10 correspond to arrows A—A and B—B shown in FIG. 1, respectively. The edge upper portion sheet sensor 7, the edge lower portion sheet sensor 6 which is not shown, and the cup portion sheet sensor 8 in FIG. 10 are provided in the same range as that in which the corresponding sensors of the electronic pad 1 stated above are provided. That is, these sensors are arranged on the right half portion of FIG. 3, i.e., the lower right half indicated by D—D of FIG. 10 and not arranged on the upper left half indicated by D—D. Thus, by providing the sensors only on the half of the electronic pad on the player side, manufacturing cost can be reduced.

Moreover, by partially cutting off the outer peripheral edge portion 43*a* of the frame 43, the shape of the frame 43 is not rotationally symmetrical and the rigidity of the frame 43 is off balance. By contrast, since the shape of the cover 2 is partially different as already stated above, the weight balance of the electronic pad 41 about the penetrating hole 4*d* is maintained but the rigidity of the frame 43 is slightly off balance. Thus, acoustic resonance can be suppressed and the electronic pad 41 in the second embodiment can further suppress unnecessary vibration generated on the frame 43.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. An electronic pad receiving a strike, detecting the strike and outputting a signal representative of the strike comprising:

a first frame;

a striking sensor detecting the strike transmitted to said first frame; and a second frame supporting said first frame from below, having an attachment hole with a pivotal joint; and a rotation stopper member coupled to the second frame for preventing said first frame from circumferentially rotating about a pole of a stand, said pole being inserted into said attachment hole, said attachment hole located in said rotation stopper member, said pivotal joint being rockably fitted into said rotation stopper member with resulting play.

2. The electronic pad according to claim 1, wherein the second frame is made of a softer material than a material for said first frame.

3. The electronic pad according to claim 1, wherein said first frame has a larger opening portion than said attachment hole of said second frame, the opening portion provided on a central portion of the first frame; and said second frame includes a head portion having said attachment hole and inserted into said opening portion from below in an upward direction, and a shoulder portion supporting a surrounding portion of said opening portion of said first frame from below, the surrounding portion surrounding the head portion.

4. An electronic pad receiving a strike, detecting the strike and outputting a signal representative of the strike, comprising:

a first frame;

a non-resonating cover covering an upper surface of said first frame, said covering having a cup portion formed on a central portion of the cover; and a striking sensor detecting the strike transmitted to said first frame through said cover;

wherein a space is formed between the cup portion and the upper surface of the first frame, such that the cup portion of the cover makes no contact with said first frame; and wherein said striking sensor adheres to a portion of said first frame covered with the cup portion formed on the central portion of said cover.

5. The electronic pad according to claim 4, wherein said cover has a dome-shaped core on the central portion, and wherein portions of the cover other than the core are formed out of a softer material than a material for said first frame.

6. The electronic pad according to claim 4, wherein said first frame has an outer peripheral edge portion formed downward by an annulus step; and wherein a portion of the cover covering said outer peripheral edge portion is thick, whereby an upper surface of said cover contacting said step is flat.

7. The electronic pad according to claim 4, wherein said cover spreads beyond a peripheral edge of said first frame and folds toward a rear surface side of the peripheral edge of the first frame.

8. The electronic pad according to claim 4, wherein said cover spreads over the entire rear surface side of the first frame.

9. The electronic pad according to claim 4, wherein said first frame is shaped such that a peripheral edge portion of the first frame is cut off; and wherein a portion of said cover covering the cut off portion of the peripheral edge portion of said first frame is formed out of more material per unit length along the peripheral edge than a material for a portion of the cover covering an uncut part of the peripheral edge portion.

10. The electronic pad according to claim 4, further comprising a sheet sensor formed on said first frame, provided on a portion between the first frame and a dome-shaped peripheral edge formed on said central portion of the cover, extending in a circumferential direction, and detecting a strike applied to said cup portion.

11. The electronic pad according to claim 10, wherein said sheet sensor extends to only a portion of said first frame in a circumferential direction.

12. The electronic pad according to claim 10, wherein said sheet sensor extends over the entire first frame in a circumferential direction.

13. The electronic pad according to claim 4, further comprising a sheet sensor provided on an upper surface of a peripheral edge portion of said first frame, and extending along no more than a part of the peripheral edge of said first frame.

14. The electronic pad according to claim 4, further comprising:

a sheet sensor provided on an upper surface of a peripheral edge portion of said first frame and extending along the entire peripheral edge of said first frame.

15. The electronic pad according to claim 4, wherein said first frame has a varying length from the center of the frame to the edge of the frame.

16. An electronic pad receiving a strike on an upper surface, detecting the strike, and outputting a signal representative of the strike; comprising:

a disk-shaped first frame;

a cover covering an upper surface of said first frame, having a cup portion formed on a central portion of the cover, a space being formed between the cup portion and the upper surface of the first frame, such that the cup portion of the cover makes no contact with said first frame;

a striking sensor adhering to a portion of said first frame covered with the cup portion formed on the central portion of said cover;

a first sheet sensor formed on said first frame between the first frame and a dome-shaped peripheral edge portion formed on the central portion of said cover, and detecting a strike applied to said cup portion;

a second sheet sensor provided on an upper surface of a peripheral edge portion of said first frame, and detecting a strike applied to the peripheral edge portion; and a third sheet sensor provided on a lower surface of the peripheral edge portion of said first frame, and detecting an operation with respect to the lower surface of the peripheral edge portion.

17. The electronic pad according to claim 16, further comprising a first jack outputting signals from a channel connected to said striking sensor and from a channel connected to said first and third sheet sensors; and a second jack outputting signals from the channel connected to said striking sensor and from a channel connected to said second sheet sensor.

18. The electronic pad according to claim 17, wherein the electronic pad is rockably attached to a pole around a predetermined horizontal axis; and said first jack and said second jack are provided near said horizontal axis.

19. The electronic pad according to claim 17, wherein the electronic pad comprises a second frame formed out of a softer material than a material for said first frame, supporting said first frame from below, and supported by the pole; and said first jack and said second jack are fixed to said second frame.

20. The electronic pad according to claim 17, wherein said first jack and said second jack are fixed to said first frame.

21. An electronic pad receiving a strike, detecting the strike, and outputting a signal representative of the strike, comprising:

a first frame;

a striking sensor detecting the strike transmitted to said first frame;

a second frame supporting said first frame from below, being rockably attached to a pole around a predetermined horizontal axis;

a rotation stopper member coupled to the second frame for preventing said first frame from circumferentially rotating about said pole, said pole being inserted into an attachment hole in said rotation stopper member; and a jack attached to the second frame and provided in sufficiently close proximity to said horizontal axis in order to minimize the stress placed on a cord attached to the jack when the pad is rocking.

22. An electronic pad receiving a strike, detecting the strike, and outputting a signal representative of the strike, comprising:

a first frame;

a non-resonating cover covering an upper surface of said first frame, said covering having a cup portion formed on a central portion of the cover, a space being formed between the cup portion and the upper surface of the first frame, such that the cup portion of the cover makes no contact with said first frame; and a sheet sensor formed on said first frame between the first frame and a dome-shaped peripheral edge portion formed on the central portion of said cover, and detecting a strike applied to said cup portion.

23. The electronic pad according to claim 1, wherein the first frame is disk-shaped.

24. The electronic pad according to claim 4, wherein the first frame is disk-shaped.

25. The electronic pad according to claim 24, further comprising a sheet sensor provided on an upper surface of a peripheral edge portion of said first frame, and extending to only a part of said first frame in a circumferential direction.

26. The electronic pad according to claim 24, further comprising a sheet sensor provided on an upper surface of a peripheral edge portion of said first frame, and extending over the entire first frame in a circumferential direction.

27. The electronic pad according to claim 24, wherein said first frame has a varying radius.

28. The electronic pad according to claim 21, wherein the first frame is disk-shaped.

29. The electronic pad according to claim 23, wherein the first frame is disk-shaped.

* * * * *